United States Patent [19]

Berardi

[11] Patent Number: 4,852,220

[45] Date of Patent: Aug. 1, 1989

[54] FLOWER MOUNTING PIN DEVICE

[76] Inventor: Joseph G. Berardi, 274 N. Goodman St., Rochester, N.Y. 14607

[21] Appl. No.: 239,643

[22] Filed: Sep. 2, 1988

[51] Int. Cl.[4] ..... A45F 5/08

[52] U.S. Cl. ..... 24/6; 24/710

[58] Field of Search ..... 24/6, 5, 13, 17 AP, 24/710, 709.8, 708.9

[56] References Cited

U.S. PATENT DOCUMENTS

| | | | |
|---|---|---|---|
| 348,332 | 8/1886 | McLane | 24/6 |
| 444,234 | 1/1891 | Hales et al. | 24/709.8 |
| 572,612 | 12/1896 | Nicolaus et al. | 24/6 |
| 849,558 | 4/1907 | Newman | 24/710 |
| 2,047,825 | 7/1936 | Johnson et al. | 24/6 |
| 2,387,474 | 10/1945 | Spokus | 24/6 |
| 2,787,819 | 4/1957 | Kaber | 24/5 |
| 3,336,638 | 8/1967 | Peters et al. | 24/6 |
| 4,477,946 | 10/1984 | Mafli | 24/6 |
| 4,597,206 | 7/1986 | Benson | 24/13 |

FOREIGN PATENT DOCUMENTS

| | | | |
|---|---|---|---|
| 0391290 | 10/1908 | France | 24/710 |

*Primary Examiner*—Victor N. Sakran

*Attorney, Agent, or Firm*—Robert J. Bird

[57] ABSTRACT

A flower mounting pin device, including a combination body and safety pin, is disclosed. The cross-shaped body includes an upright member and a transverse crossbar. The upright member includes projecting nubs and a through hole spaced along it. The crossbar includes a transverse pin channel with a central keyslot, and a hinged cover which closes over the pin channel to secure the safety pin within the pin channel. The crossbar and the hinged cover further include mating male and female elements to secure the cover in its closed positon over the pin channel. The safety pin includes a stationary arm which fits in the pin channel of the crossbar. The stationary arm has a central offset portion which extends into the central keyslot, securing the safety pin against rotation and translation within the pin channel. Various sizes of safety pins can be used, all with the same benefits.

4 Claims, 1 Drawing Sheet

FLOWER MOUNTING PIN DEVICE

BACKGROUND OF THE INVENTION

This invention is a mounting pin device on which to mount a flower or the like, and by which to pin the mounted flower to clothing.

Flowers are worn, on occasion, as an accessory on clothing to enhance appearance and aesthetics. These flowers, boutonnieres, corsages, and the like are typically tape wrapped around their stem portions, and fastened to clothing by means of a straight pin or a safety pin pushed through the taped stem and then through the clothing.

The pinning on of a corsage or boutonnierre by this conventional method can be a cumbersome operation, especially for the unpracticed. Then, even if it is pinned on in the desired attitude, the flow may be free to tilt relative to its anchor point on the clothing, and in some cases even to flop upside down. There is also the possibility of injury from the exposed pin point.

One device which addresses these shortcomings of the conventional prior art is disclosed in U.S. Pat. No. 4,477,946, issued Oct. 23, 1984 to Mafli. The Mafli patent discloses a T-shaped flower mounting pin including a transverse head portion with a safety pin fixed to it, and an elongated vertical shaft portion. Flower stems are tape wrapped to the shaft portion, and the device is then pinned to clothing in the same manner as a badge. Other small details are disclosed in the patent, the specification of which is incorporated herein by reference. The Mafli patent is the closest prior art of which I am aware.

SUMMARY OF THE INVENTION

In summary, the present invention is a flower mounting pin device, including a combination body and safety pin. The cross-shaped body includes an upright member and a transverse crossbar. The upright member includes projecting nubs and a through hole spaced along it. The crossbar includes a transverse pin channel with a central keyslot, and a hinged cover which closes over the pin channel to secure the safety pin within the pin channel. The crossbar and the hinged cover further include mating male and female elements to secure the cover in its closed position over the pin channel. The safety pin includes a stationary arm which fits in the pin channel of the crossbar. The stationary arm has a central offset portion which extends into the central keyslot, securing the safety pin against rotation and translation within the pin channel. Various sizes of safety pins can be used, all with the same benefits.

DESCRIPTION OF THE PREFERRED EMBODIMENT

Figure 1:
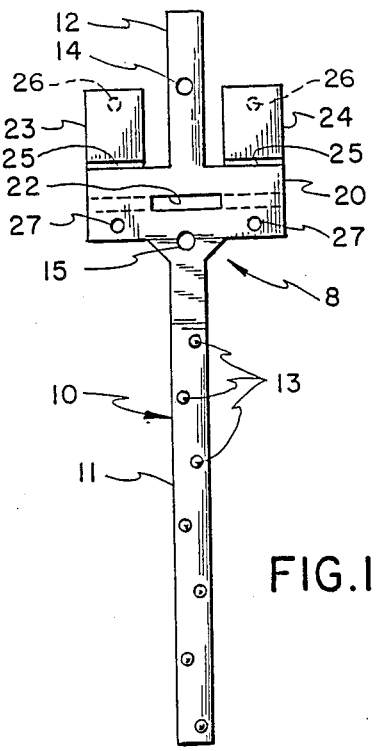
FIG. 1 is an elevated view of the body of a flower mounting pin according to this invention.
Figure 2:
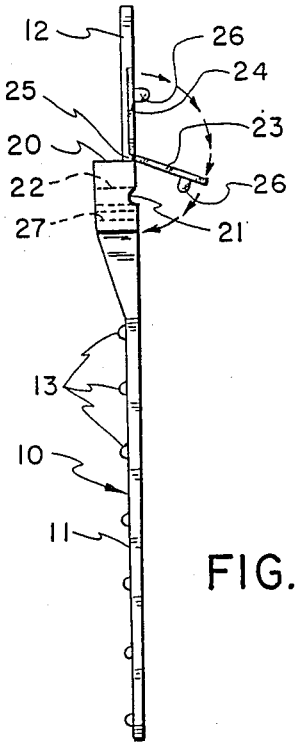
FIG. 2 is a side view from the right side of FIG. 1.
Figure 3:
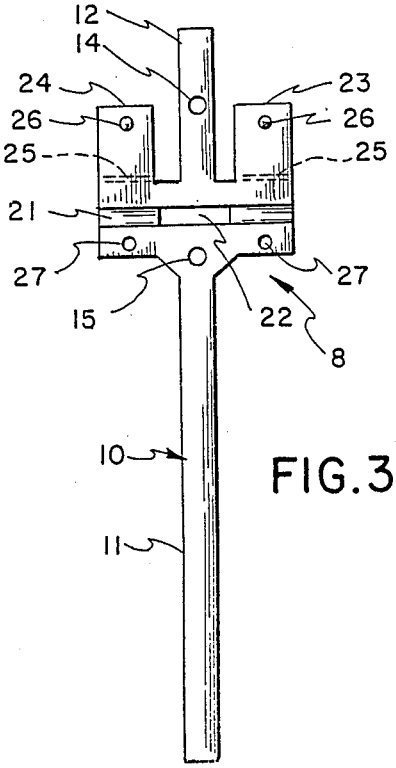
FIG. 3 is a rear view of the complete flower mounting pin of FIG. 1.

Referring now to the drawing, the flower mounting pin device of this invention includes a body 8 and a safety pin 30. The body 8 is preferably a single piece plastic molded part, and includes an upright member 10 and a transverse crossbar 20.

The upright member 10 includes a lower portion 11 below the crossbar, and an upper portion 12 above the crossbar. The lower portion 11 includes several projecting nubs 13 spaced along its length. The upper portion 12 includes a through hole 14. A similar through hole 15 is formed in the lower portion 11 at or near its juncture with the crossbar.

The crossbar 20, which is integral with the upright member 10, includes a transverse pin channel 21. Pin channel 21 in turn includes a central keyslot 22 which may extend entirely through the crossbar 20, or may simply be deeper than the rest of the channel 21. the crossbar 20 further includes a pair of hinged covers 23 and 24, one on each side of the upright member 10. Covers 23 and 24 are connected and hinged to the crossbar 20 by hinge membranes 25. Covers 23 and 24 are shown raised in their open positions.

Each of the covers 23 and 24 includes a projecting closure plug 26. Crossbar 20 includes a pair of closure plug holes 27, each closure plug hole being in registry with one of the closure plugs 26. Plugs 26 and plug holes 27 are so dimensioned that the plugs 26 fit snugly within the holes 27 when covers 23 and 24 are closed. Plugs 26 are on the covers, and plug holes 27 in the crossbar, although this arrangement might be reversed, with plugs 26 on the crossbar and plug holes 27 in the covers.

Figure 4:
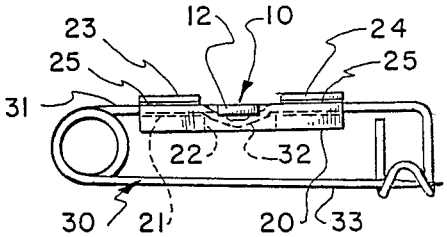
FIG. 4 is a top view of the body of FIG. 1 with an attached pin.

In FIG. 4, the safety pin 30 includes a stationary pin arm 31, having a central offset or dimple portion 32, and a movable pin arm 33. The stationary arm 31 of the pin is inserted in the transverse pin channel 21 of the crossbar 20. The central offset portion 32 of the pin arm 31 extends beyond the depth of the pin channel 21 and into the central keyslot 22, effectively locking the safety pin against both rotation and axial translation within the pin channel 21. With the safety pin 30 in place, the covers 23 and 24 are closed over the pin and are held closed by the mating engagement of the respective plugs 26 and plug hole 27. The safety pin is thus further locked in place and prevented form ejection from the pin channel by the hinged covers 23 and 24. The safety pin is held firmly in position, extending outward from the crossbar 20 as shown in FIG. 4, greatly facilitating its manipulation and use with the thumb and forefinger of one hand. In short, the pin does not rotate or flop about in the pin channel making it difficult to grasp; it stands out firmly from the crossbar.

Figure 5:
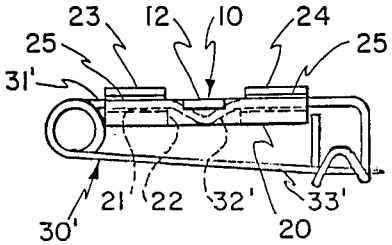
FIG. 5 is a top view of the body of FIG. 1 with a smaller attached pin.

The cooperative action of the safety pin 30, with its central offset 32, and the body crossbar 20, with is pin channel 21 and central keyslot 22, permits the use of various sizes of safety pins with a single size of body 8. A smaller safety pin 30' (FIG. 5), similarly configured, will be interchangeable with the safety pin 30. The smaller pin 30', like pin 30, is prevented from both axial translation and rotation within the pin channel 21 by the locking engagement of its central offset portion 32' with the keyslot 22. That the body 8 can be used with different size pins is significant. For use with a corsage or large flower cluster, a larger pin 30 is preferred for support and for the sake of the garment to which it will be attached. A small pin 30' is adequate for a boutonniere, and indeed preferred because it will remain invisible behind the smaller flower.

In mounting a flow, boutonnierre, corsage or the like to this flower mounting pin device, the stem or stems are aligned with the lower portion 11 of the body and. tape wrapped thereto. The several nubs 13 add to the frictional engagement of the tape on the lower body portion 11. The body upper portion 12, and the through holes 14 and 15, facilitate additional flower support if needed, as for example with a corsage or large flower cluster. The upper portion 12 adds length (or height) to the upright member 10, and the holes 14 and 15 are provided for tie wires. When the device is used with a boutonniere, the upper portion 12 will not be needed and can simply be cut off.

The above-described combination of body 8 and safety pin 30 is my presently preferred embodiment of this invention. I recognize, however, that a functionally equivalent structure might be achieved by embedding the safety pin stationary arm 31 within the crossbar 20 in the process of molding the body. While such a configuration would eliminate the necessity of such elements as the pin channel, keyslot, and hinged covers, I believe it would be economically disadvantageous as compared with the preferred embodiment described. The molded combination is, however, contemplated as a possible alternative embodiment, within the scope of this invention.

The term "central" is used herein as an adjective in connection with keyslot 22 and with offset 32 in a relative sense meaning "between the extremities". It does not necessarily mean "centered". The term "safety pin" herein is not limited to the safety pin in its standard and familiar form, but rather in a general sense to mean an openable and closable pin with a clasp.

The foregoing description of this invention is intended as illustrative. The concept and scope of the invention are limited only by the following claims and equivalents thereof.

What is claimed is:

1. A flower mounting pin device including a body and a safety pin removably mounted thereon;

said body including an upright member and a transverse crossbar; said crossbar including a transverse pin channel with a central keyslot therein, and a hinged cover adapted to close over said channel to secure said safety pin within said pin channel;

said safety pin including a stationary arm disposed in said transverse pin channel of said crossbar, said stationary arm having a central offset portion extending into said central keyslot to secure said safety pin against rotation and translation within said pin channel.

2. A flower mounting pin device as defined in claim 1, further including projecting nubs and a through hole spaced along the length of said upright member, and means to secure said hinged cover in its closed position over said pin channel.

3. A flower mounting pin device as defined in claim 1:

said upright member including a lower portion below said crossbar and an upper portion above said crossbar, said lower portion including projecting nubs spaced therealong, said upper portion including a through hole;

said crossbar and said hinged cover further including mating male and female elements to secure said cover in its closed position over said pin channel.

4. A flower mounting pin device as defined in claim 1, further including at least two of said hinged covers on said crossbar, at least one of said hinge covers on each side of said upright member.

* * * * *